US008601955B2

(12) United States Patent
Casey et al.

(10) Patent No.: US 8,601,955 B2
(45) Date of Patent: Dec. 10, 2013

(54) CORRUGATED PAPER PALLET

(75) Inventors: Christopher Casey, Toronto (CA); Janet Lynn Duffield, Toronto (CA)

(73) Assignee: The Corrugated Pallets Company, Toronto, Ontario (CA)

( * ) Notice: Subject to any disclaimer, the term of this patent is extended or adjusted under 35 U.S.C. 154(b) by 0 days.

(21) Appl. No.: 13/809,470

(22) PCT Filed: Jul. 7, 2011

(86) PCT No.: PCT/IB2011/002193

§ 371 (c)(1), (2), (4) Date: Jan. 10, 2013

(87) PCT Pub. No.: WO2012/010967

PCT Pub. Date: Jan. 26, 2012

(65) Prior Publication Data

US 2013/0112117 A1 May 9, 2013

Related U.S. Application Data

(60) Provisional application No. 61/399,242, filed on Jul. 12, 2010.

(51) Int. Cl.
*B65D 19/00* (2006.01)

(52) U.S. Cl.
USPC ..... 108/51.3

(58) Field of Classification Search
USPC ..... 108/51.3, 51.11, 56.1, 56.3
See application file for complete search history.

(56) References Cited

U.S. PATENT DOCUMENTS

| | | | | | |
|---|---|---|---|---|---|
| 2,709,559 | A * | 5/1955 | Geisler | 108/51.3 |
| 2,716,532 | A * | 8/1955 | Wysong, Jr. et al. | 108/56.3 |
| 2,928,638 | A * | 3/1960 | Parker | 108/51.3 |
| 3,006,590 | A * | 10/1961 | Hoag | 108/51.3 |
| 3,425,367 | A * | 2/1969 | Oravez | 108/51.3 |
| 3,952,672 | A * | 4/1976 | Gordon et al. | 108/51.3 |
| 5,129,329 | A * | 7/1992 | Clasen | 108/51.3 |
| 5,230,291 | A * | 7/1993 | Juvik-Woods | 108/51.3 |
| 5,285,731 | A * | 2/1994 | McIntyre | 108/51.3 |
| 5,385,103 | A * | 1/1995 | Juvik-Woods | 108/51.3 |
| 5,433,156 | A * | 7/1995 | Hutchison | 108/51.3 |
| RE35,131 | E * | 12/1995 | Youell et al. | 108/51.3 |
| 5,517,926 | A * | 5/1996 | Young, Jr. | 108/51.3 |
| 5,531,165 | A * | 7/1996 | Taravella et al. | 108/51.3 |
| 5,531,166 | A * | 7/1996 | Woods et al. | 108/51.3 |
| 5,595,125 | A * | 1/1997 | Bridges, Jr. | 108/51.3 |
| 6,095,061 | A * | 8/2000 | Perazzo | 108/51.3 |
| 6,357,364 | B1 * | 3/2002 | Maloney et al. | 108/51.3 |
| 6,736,074 | B2 * | 5/2004 | Pistner et al. | 108/51.3 |
| 2002/0189507 | A1 * | 12/2002 | Benner | 108/51.3 |
| 2004/0045486 | A1 * | 3/2004 | Pistner et al. | 108/51.3 |
| 2006/0236899 | A1 * | 10/2006 | Nelson | 108/51.3 |
| 2006/0243172 | A1 * | 11/2006 | Simon | 108/51.3 |
| 2008/0163800 | A1 * | 7/2008 | Reilly et al. | 108/51.3 |

* cited by examiner

*Primary Examiner* — Jose V Chen

(74) *Attorney, Agent, or Firm* — Michael A. Ervin; M. A. Ervin & Associates

(57) ABSTRACT

A method and apparatus for providing pallet runners and pallets constructed using them for use in the storage and/or transport of goods and, more particularly, to a low cost, strong, recyclable, reinforced pallet and runner design.

9 Claims, 18 Drawing Sheets

CORRUGATED PAPER PALLET

FIELD OF THE INVENTION

This invention relates to pallet runners and pallets constructed using them for use in the storage and/or transport of goods and, more particularly, to a recyclable reinforced corrugated pallet and runner design.

BACKGROUND OF THE INVENTION

Various objects have been used to handle, separate and support loads that are sorted, stored and transported in a stacked arrangement. The equipment that is primarily used for performing this stacking arrangement is a front-end loader, lift truck or forklift truck that raises the individual loads so that they can be stacked one on top of the other or on a rack. To separate the loads from each other or off of the floor a pallet or runners are positioned beneath the load so as to allow space for the insertion of the forks of the lift truck for moving and positioning the loads for sorting, storing and transporting.

Packaging has a need for pallets that are economically priced and ecologically feasible. An acceptable pallet must possess the strength to support their intended loads of 2,400 Kg and work with industry-accepted material handling equipment. It is also necessary that the pallet can resist immediate deterioration by atmospheric or ground/floor moisture. The smooth clean topside of the pallet top sheet and the bottom side of the bottom sheet provides a surface that will not damage packaging. This pallet invention is economically priced to new wood pallets.

The significant challenge packaging faces with the use of wood pallets is the additional cost both in terms of material and labor using a corrugated sheet to separate packaging from the wood pallet. Damage is done to packaging from the nails, staples or other fasteners used to manufacture wood pallets.

The pallet addresses the needs of industry by satisfying these key issues and overcomes the associated disadvantages and shortcomings of known corrugated pallet and runner designs. Design drawbacks include not being economical when compared to new wood pallets, their strength and rigidity under static and dynamic loading is insufficient to permit wide spread general usage for all types and distribution of goods. Such pallets often have excessive deflection and lack beam strength, which causes their sagging under loads, thereby making the handling, stacking and racking of the pallets impractical. Additionally, known paperboard pallet designs typically become compressed, crushed, milled off or damaged when used under loads unless the percentage of corrugated is increased in the runner dramatically. Other known corrugated pallet designs may lose up to 50 percent of its stacking strength during conditions of high humidity and moisture when the paperboard absorbs atmospheric or ground/floor moisture. The most significant obstacle facing known corrugated designs is the capital investment in equipment required to manufacture runners and pallets in separate markets economically that will perform like a wood pallet.

The typical wood pallet used with packaging consists of platforms having parallel runners longitudinally and or transversely secured to their undersides by means of nails, staples or other fasteners. Wood is used in the construction of pallets because it is extremely strong on a weight basis, easily machined with off the shelf tools and will not lose its strength when exposed to heat, moisture or humidity. Wood pallets have several major disadvantages that are environmental in nature. Increasing environmental awareness has become a significant factor in the packaging, transportation and shipping industries. Wood is difficult to readily recycle on site and often wood packaging or pallet components are finally disposed in landfills. Available landfill sites, however, are becoming full and are being closed. If landfill disposal is even available, dumping fees are prohibitive. The decreasing supply of readily available wood is raising the cost of such pallets, however, and such wooden pallets are heavy and bulky to transport.

In international shipment of goods, wooden pallets present additional environmental problems because they tend to serve as hosts for germs and bugs. As a result, pallets are often quarantined in another country according to governmental regulations or general precautionary practices to avoid the spread of undesirable insects, bugs or germs. This has proven to be very costly and a significant economic drawback. This pallet is exempt under ISPM regulations.

Thus, there is an increasing need for pallets that are economically and ecologically feasible. However, an acceptable pallet must possess the strength to support their intended loads particularly on a rack or conveyor and must be sufficiently durable to withstand repeated use including being lifted with a lift truck or the like while loaded. Further, desirably the pallet must resist deterioration by the elements of the weather. Moreover, an acceptable pallet must be competitively priced in the marketplace.

BRIEF SUMMARY OF THE INVENTION

The design of the runner and pallet addresses the drawbacks evident in other known corrugated pallet designs. This includes a method to assemble the runners economically. 65% lighter than wood pallets so that CO2 emissions are reduced during transit, water resistant, ISPM compliant and are 100% recyclable in paperboard recycling systems available locally. The significant strength and increased load bearing capability allows the runner and pallet to resist compression or crushing when supporting heavy loads.

The construction of an one hundred percent recycled runner using two strips of paperboard positioned on the outside edge of a honeycomb block bonded with adhesive and covered with a die cut sheet spray coated with a refined petroleum and vegetable wax blend provides compression resistance and stability so that the runner does not buckle or crush when loaded. This invention combines three components into one design that offers beam strength, compression resistance and stability at a cost point that is not available with known corrugated runner designs. The two way or four way access feature with this design is commercially viable alternative to wood pallets while performing similar to a wood pallet.

This need is met by a corrugated pallet for supporting a load during transport and storage including at least: a series of spaced parallel two way access runners, each of the runners comprising the following components: a rectangular corrugated block; two paperboard strips; a die cut corrugated sheet using a C flute; a corrugated top sheet joined to the tops of the runners using adhesive applied to the horizontal upper surface of the runner; and a corrugated bottom sheet joined to the bottoms of the runners using adhesive to the horizontal bottom surface of the runner.

The need is also met by a corrugated pallet for supporting a load during transport and storage including at least: a series of spaced parallel four way access runners, having openings extending the entire width of the runner in a direction perpendicular to a longitudinal axis of the runner, each of the runners comprising the following components: three rectangular corrugated blocks; six paperboard strips; a die cut corrugated sheet using a C flute. a corrugated top sheet joined to the tops of the runners using adhesive applied to the horizontal upper surface of the runner; and a corrugated bottom sheet joined to the bottoms of the runners using adhesive to the horizontal bottom surface of the runner.

In another aspect corrugated pallet further includes at least a sprayed coating of a petroleum and vegetable wax blend over the completed pallet.

The need is also met by a method for preparing a corrugated runner for a corrugated pallet including at least the steps of: preparing a die cut corrugated sheet comprising five joined parallel segments, with the second and fourth segments having extended end flaps; spray coating an adhesive on the interior side of the die cut corrugated sheet, coating all five joined parallel segments and their end flaps; glueing a rectangular corrugated block on the second segment of the die cut corrugated sheet; placing strips of paperboard onto the first and third parallel and adhesively coated segments; folding and pressing said first and third parallel segments with attached strips of paperboard against said rectangular corrugated block on the second segment of the die cut corrugated sheet; pressing the adhesively coated fourth parallel segment against the top of said rectangular corrugated block, allowing the adhesively coated fifth parallel segment to wrap over the top and cover the outside of the first parallel segment; pressing two adhesively coated end flaps down on each end of the assembled runner to provide double coverage of the ends.

DETAILED DESCRIPTION OF THE INVENTION

Figure 1:
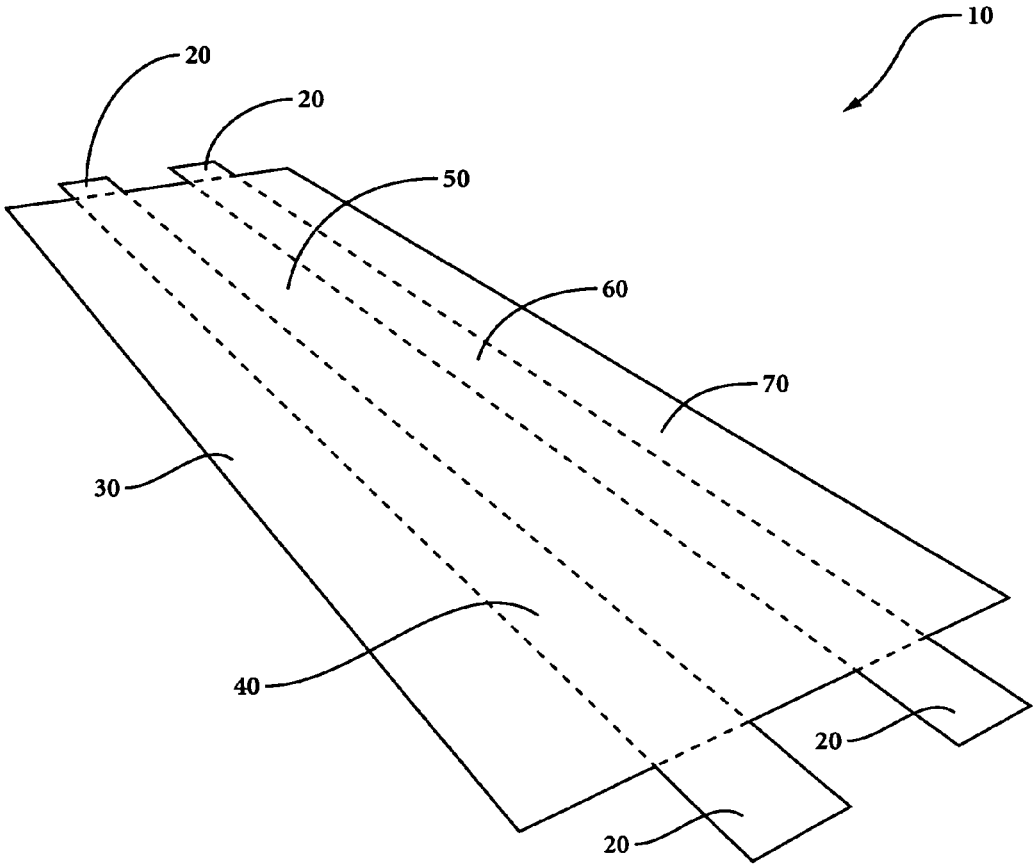
FIG. 1 is a perspective view of a die-cut corrugated paper sheet.

FIG. 1, shown generally by the numeral 10, illustrates a die cut pallet runner cover sheet of corrugated board that forms the basis for a pallet runner of the instant invention. Die-cutting of corrugated sheet is common in the industry. This one is cut to specific dimensions to exactly fit the dimensions of the eventual runner. End cover flaps 20 on each end of the sheet will eventually seal the ends of the runner. Segments 30,40,50,60, and 70 are different segments of the base corrugated sheet.

Figure 2:
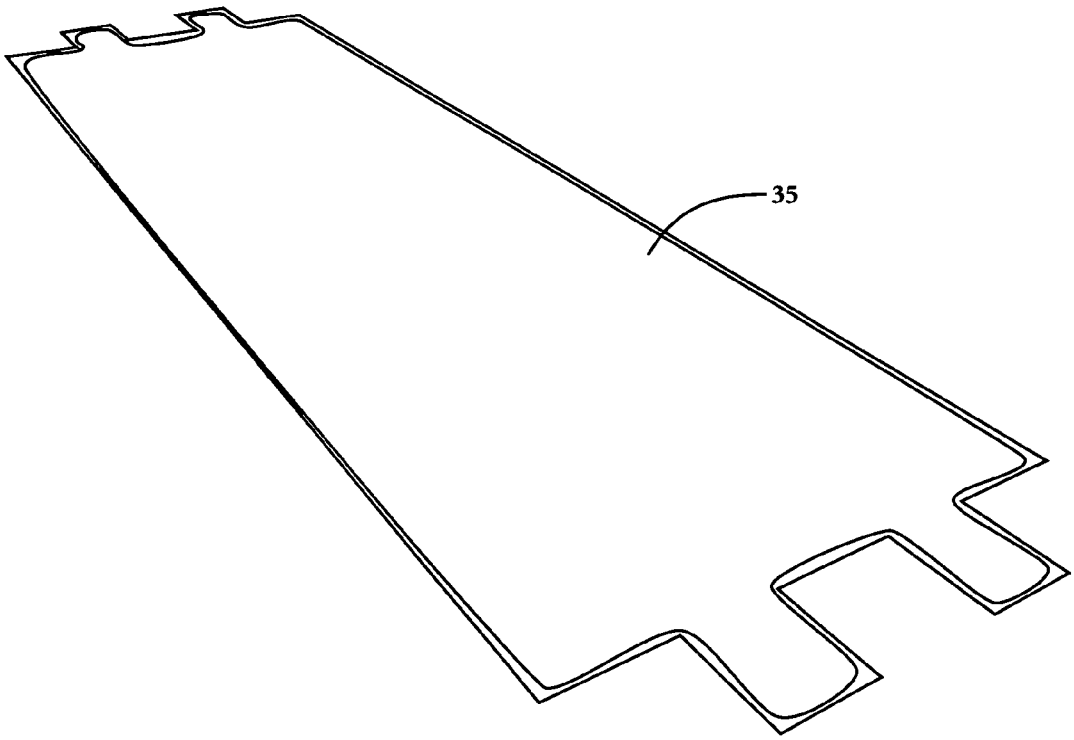
FIG. 2 is a perspective view of a die-cut corrugated paper sheet coated with an adhesive on the inside surface.

FIG. 2 demonstrates a coating 35 of an adhesive on the inside surface of the corrugated die-cut sheet 10 of FIG. 1. This application could be done manually but in a preferred embodiment will be done automatically as part of a machine sequence.

Figure 3:
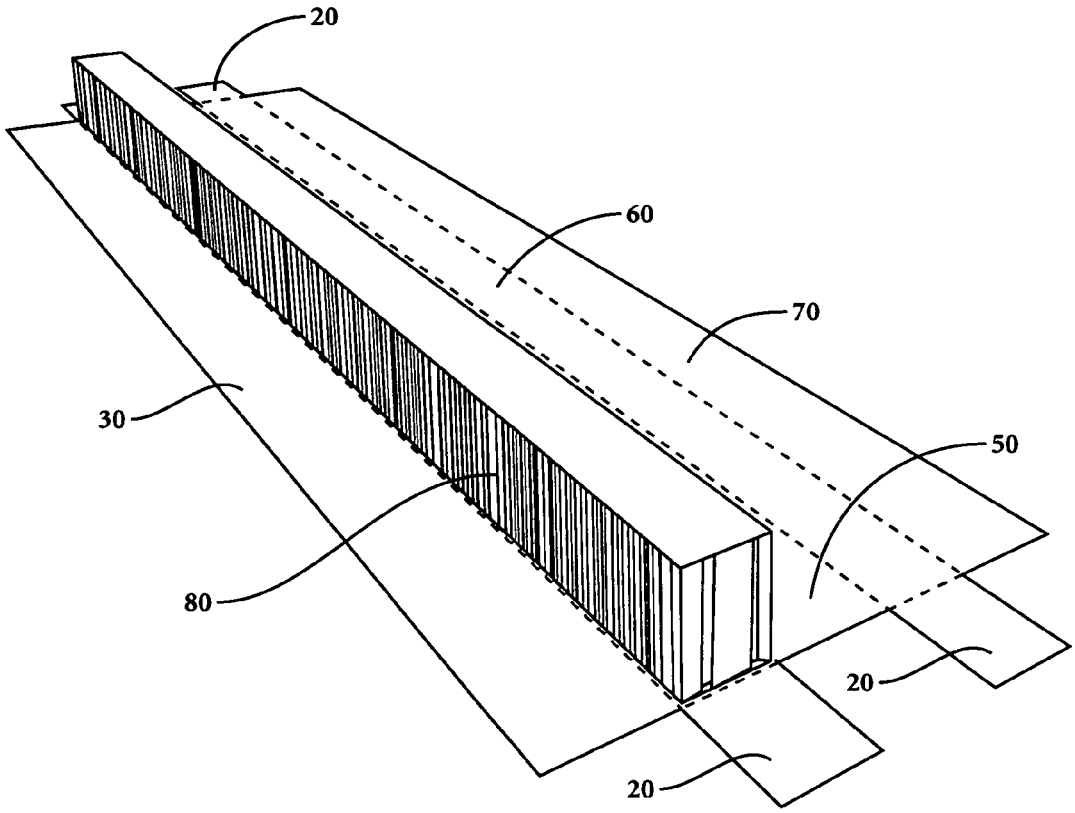
FIG. 3 is a perspective view of a die-cut corrugated paper sheet with a honeycomb block added.

FIG. 3 shows the placement of an extended honeycomb block 80 on adhesive coated segment 40 of corrugated sheet 10. Honeycomb block is standard corrugated filler in the industry and a preferred embodiment. It acts only as void filler in the instant invention. Accordingly, other corrugated blocks could be used instead and the invention anticipates any of them.

Figure 4:
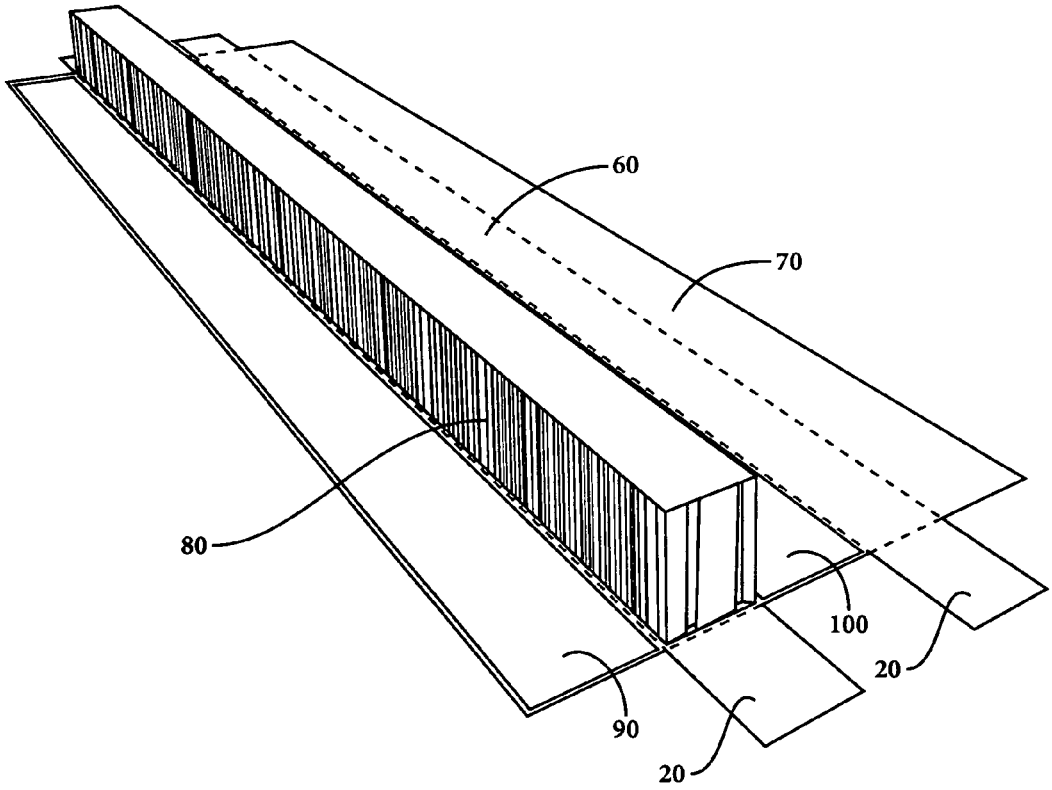
FIG. 4 is a perspective view of a die-cut corrugated paper sheet with honeycomb block and strip of paperboard applied to each side of the block.

FIG. 4 shows the placement of two strips of paperboard 90, 100 onto adhesive coated segments 30 and 50 of corrugated sheet 10. Both the paperboard strips and the honeycomb block have been pre-cut to fit exactly onto their segments.

Figure 5:
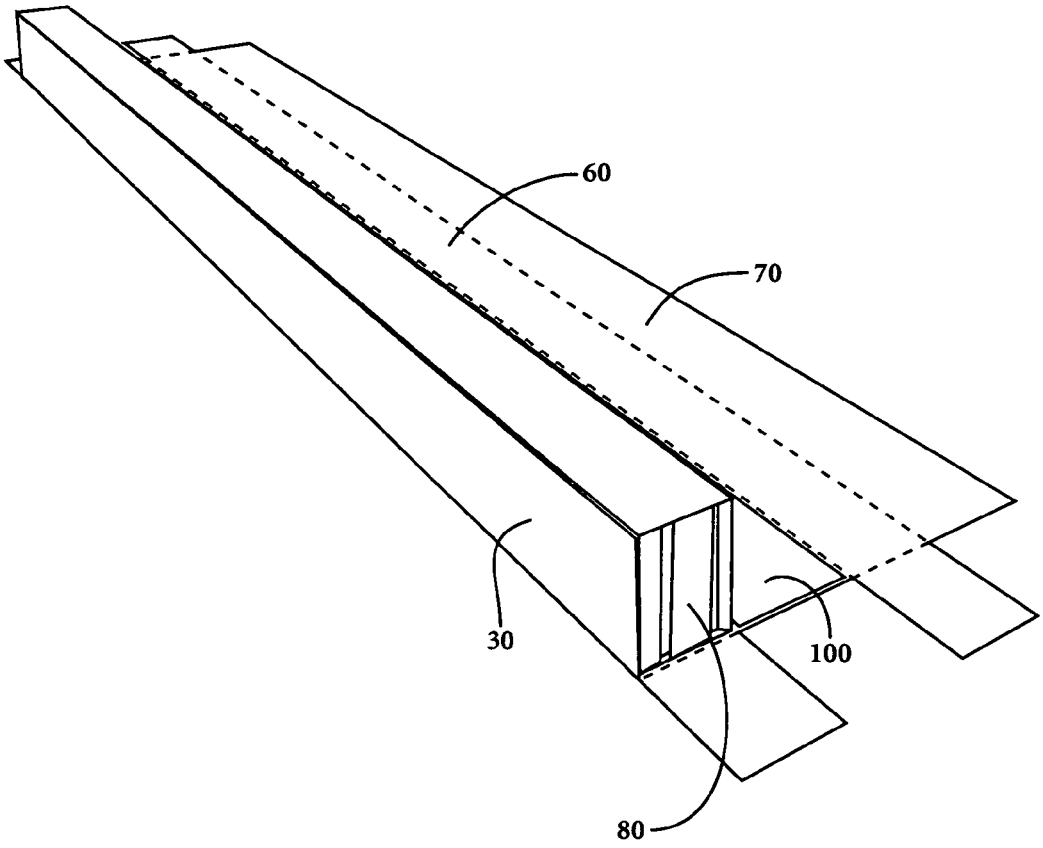
FIG. 5 is a perspective view of a step in the method of runner assembly.
Figure 6:
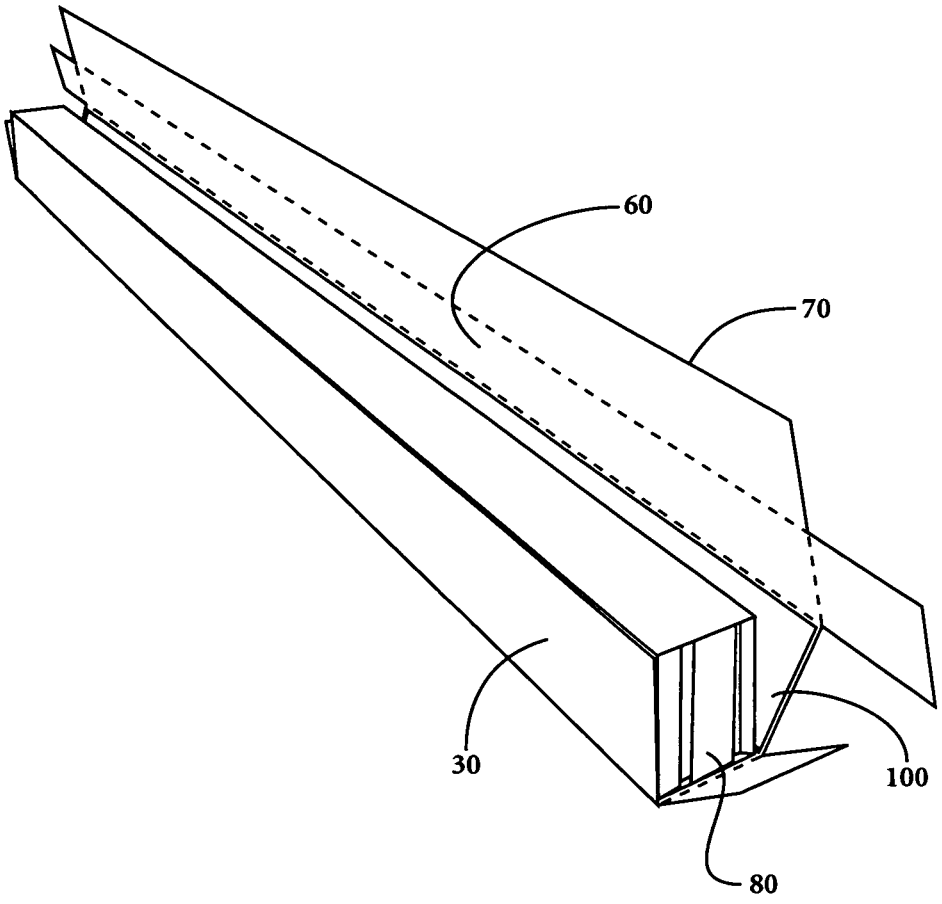
FIG. 6 is a perspective view of a step in the method of runner assembly.
Figure 7:
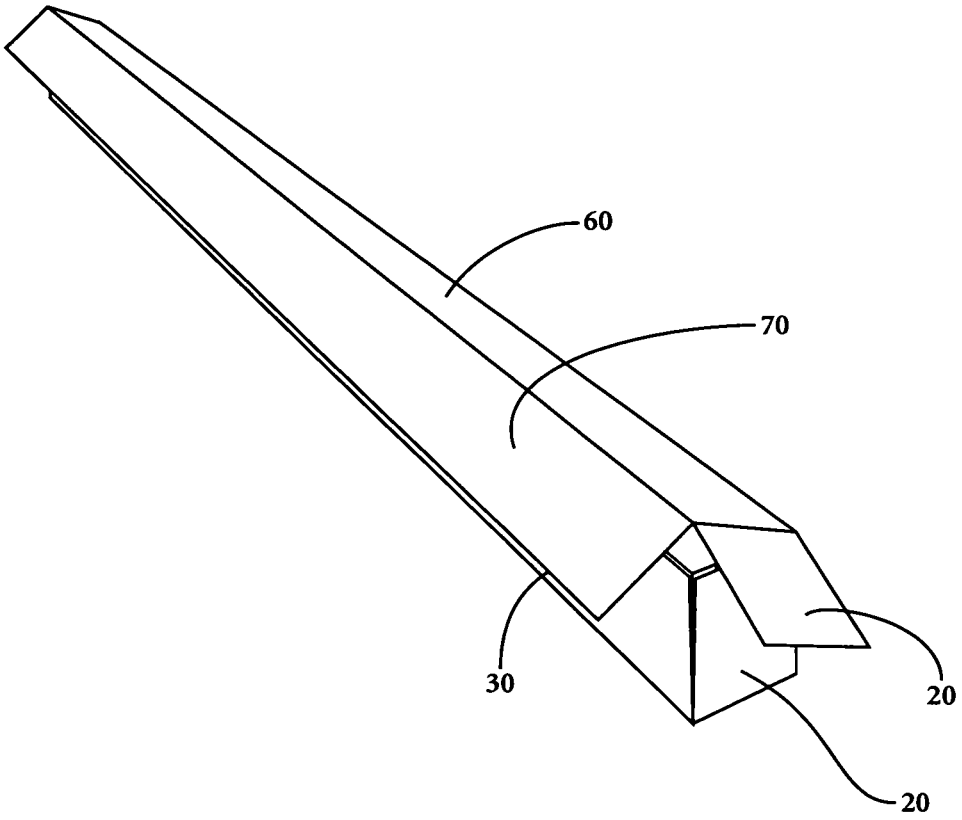
FIG. 7 is a perspective view of a step in the method of runner assembly.
Figure 8:
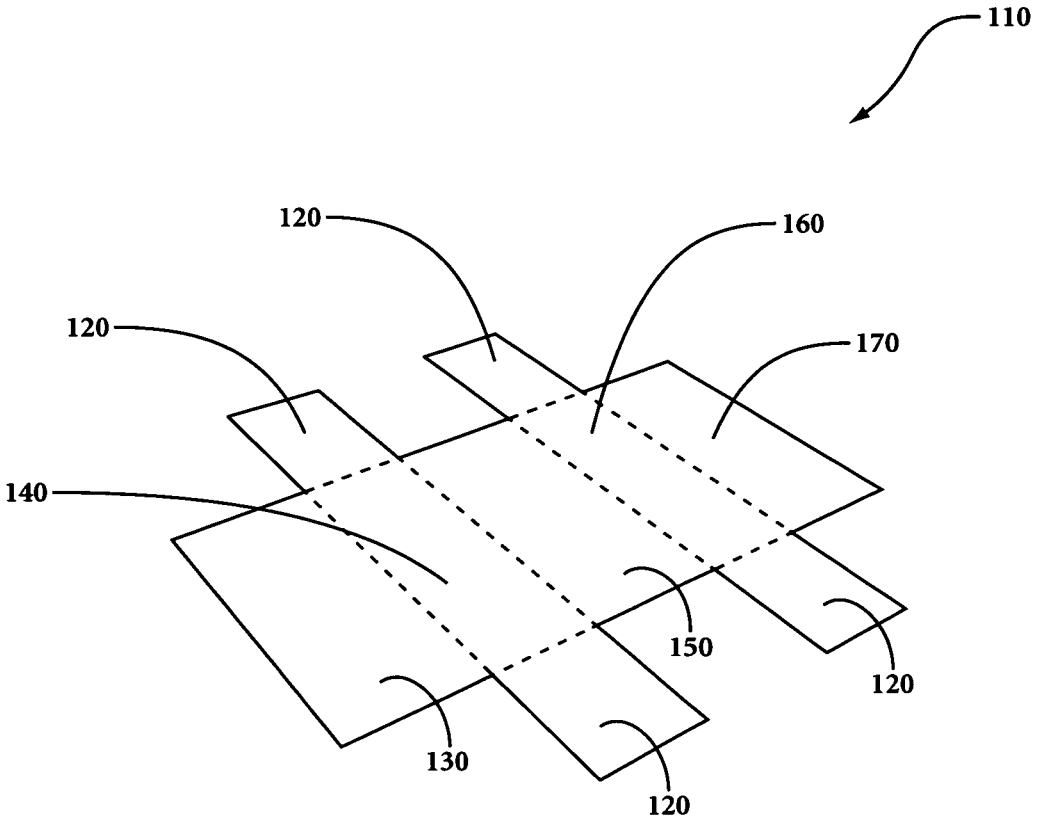
FIG. 8 is a perspective view of a die-cut corrugated paper sheet.

The runner is now prepared for final assembly. As seen in FIG. 5 and FIG. 6 segments 30 and 50 are folded up and press the paperboard strips 90, 100 against honeycomb block 80. Segment 60, with adhesive, is then pressed against the top of honeycomb block 80, allowing segment 70 to wrap over the top and cover the outside of segment 30 (FIG. 7), sealed by the adhesive. Segment 70 is further kept in place by application of several pieces of tape such as, for example, Kraft tape. The end cover flaps 20 on each end are also then pressed down to provide double coverage of the ends of the runner. The completed runner is then spray coated with a refined petroleum and vegetable wax blend (not shown) to seal the corrugated board from moisture.

Figure 15:
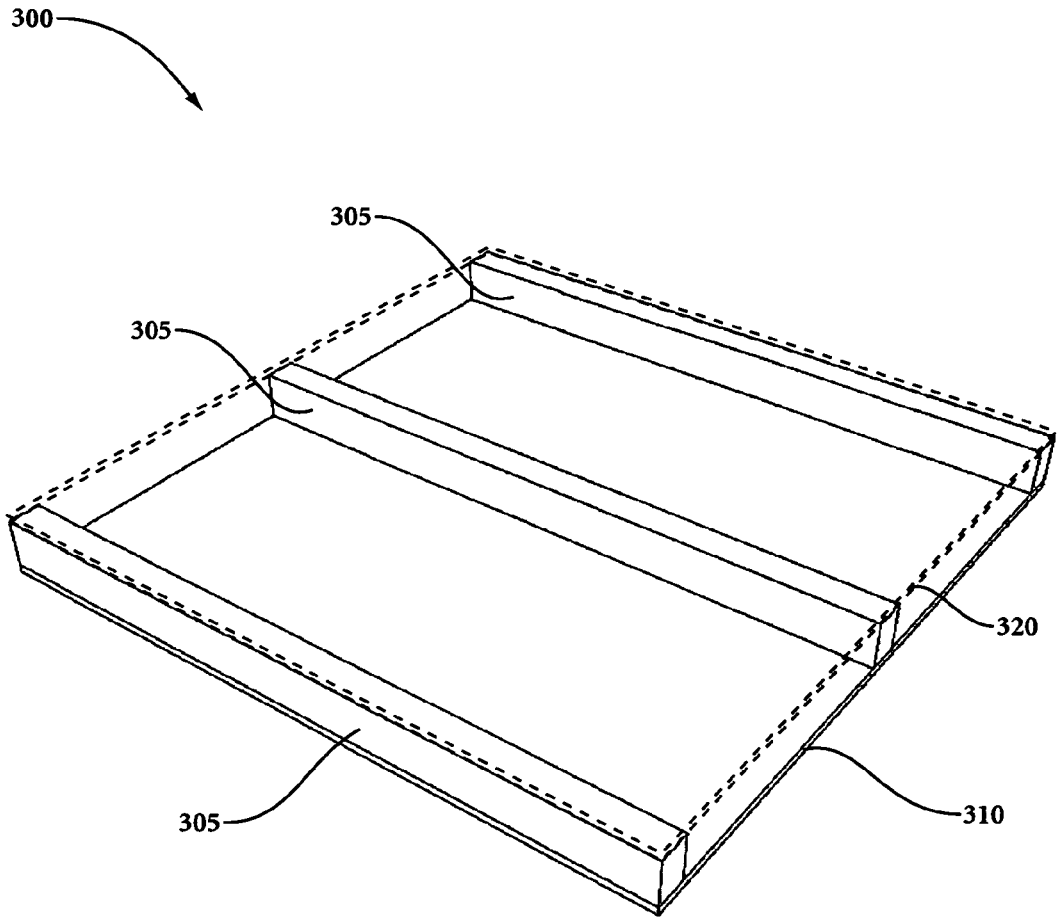
FIG. 15 is a perspective view of a pallet embodiment of the invention.

Assembly of an embodiment of a final pallet 300 is then completed by first coating the top and bottom of the runners with adhesive and then spacing at least three runners 305 across and between a top 320 and bottom 310 corrugated sheet as shown in FIG. 15. For illustrative purposes the top sheet is shown as transparent in order to see the placement of the three runners.

Figure 16:
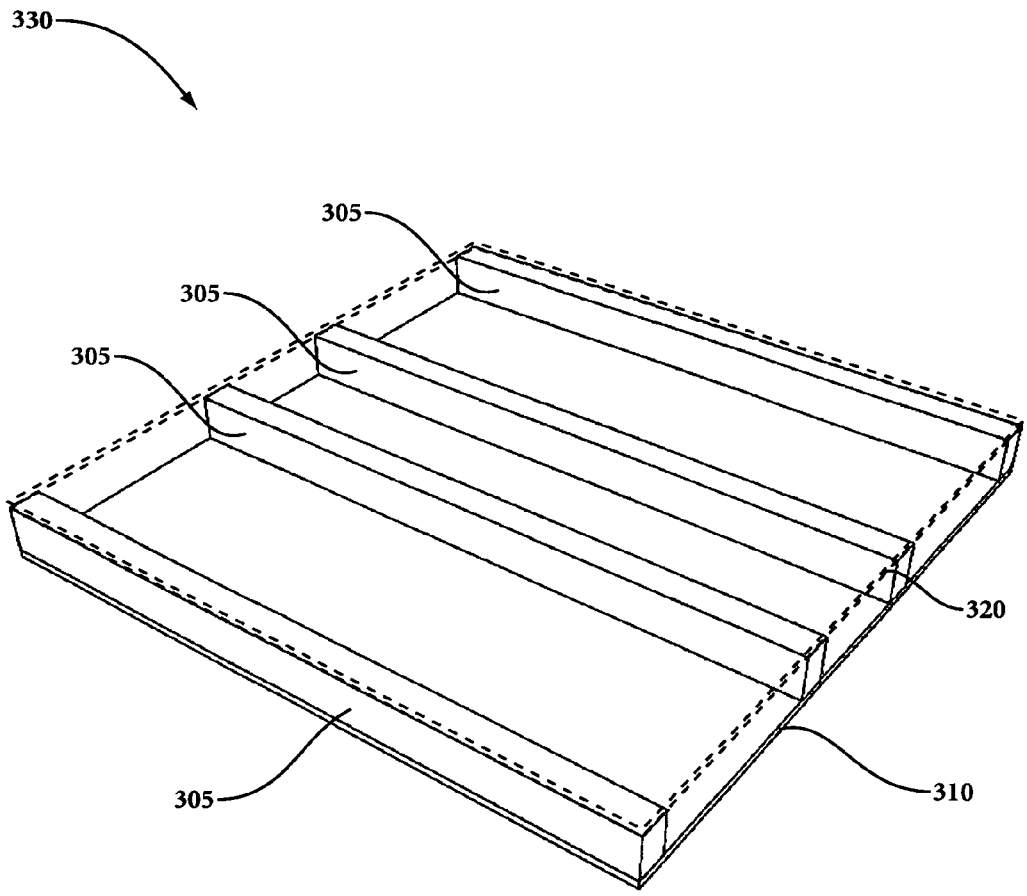
FIG. 16 is a perspective view of a pallet embodiment of the invention.

In another embodiment, FIG. 16 shows four runners 305 spaced across pallet 330, providing extra strength.

Because it is often advantageous to be able to access pallets from all sides a second embodiment of the instant invention is also proposed. Instead of an extended runner as proposed in FIGS. 1-7, FIG. 8, shown generally by the numeral 110, illustrates a much shorter die cut pallet runner cover sheet of corrugated board that forms the basis for a second pallet runner (the short block runner) of the instant invention. This sheet is also cut to specific dimensions to exactly fit the dimensions of the eventual runner. End cover flaps 120 on each end of the sheet will eventually seal the ends of the runner. Segments 130, 140, 150, 160, and 170 are different segments of the base corrugated sheet.

Figure 9:
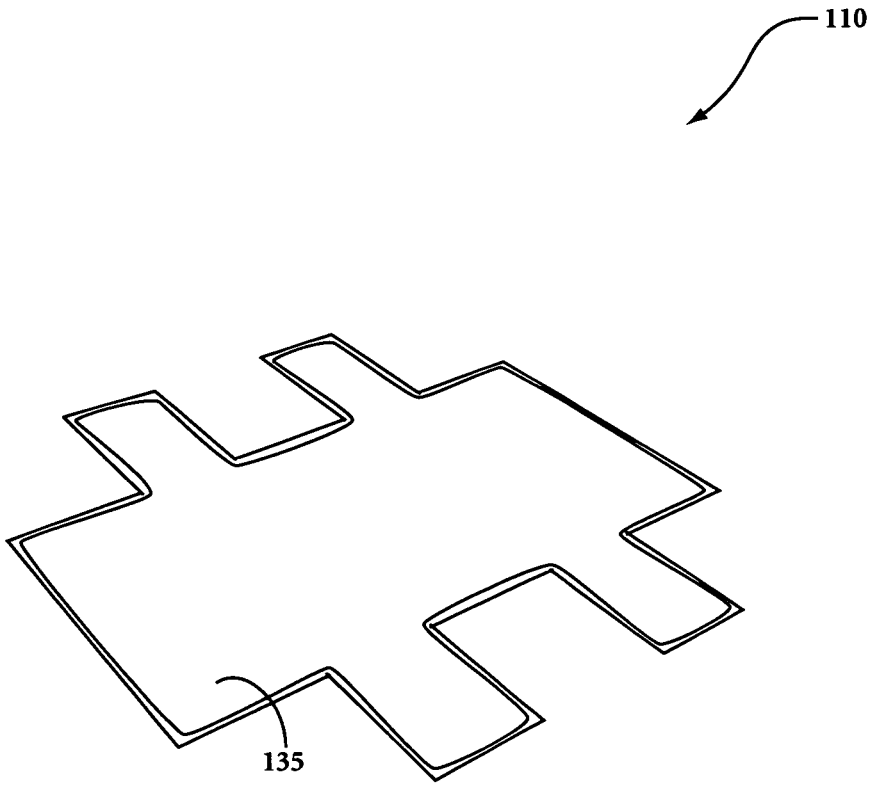
FIG. 9 is a perspective view of a die-cut corrugated paper sheet coated with an adhesive on the inside surface.

FIG. 9 demonstrates a coating 135 of an adhesive on the inside surface of the corrugated die-cut sheet 110. This application could be done manually but in a preferred embodiment will be done automatically as part of a machine sequence.

Figure 10:
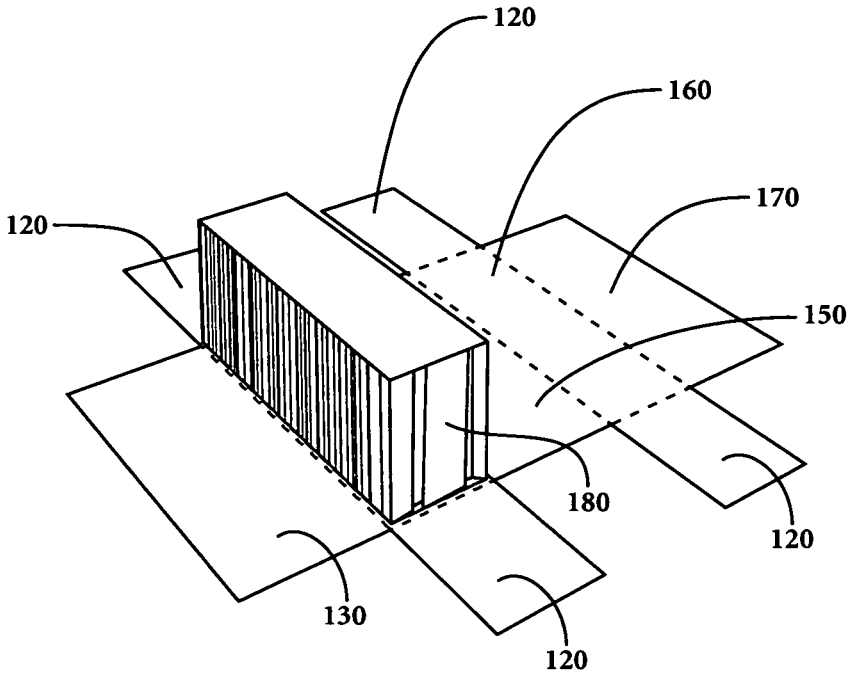
FIG. 10 is a perspective view of a die-cut corrugated paper sheet with a honeycomb block added.

FIG. 10 shows a honeycomb block 180 on placed on adhesive coated segment 140 of corrugated sheet 110. Honeycomb block is standard corrugated filler in the industry and a preferred embodiment. It acts only as void filler in the instant invention. Accordingly, other corrugated blocks could be used instead and the invention anticipates any of them.

Figure 11:
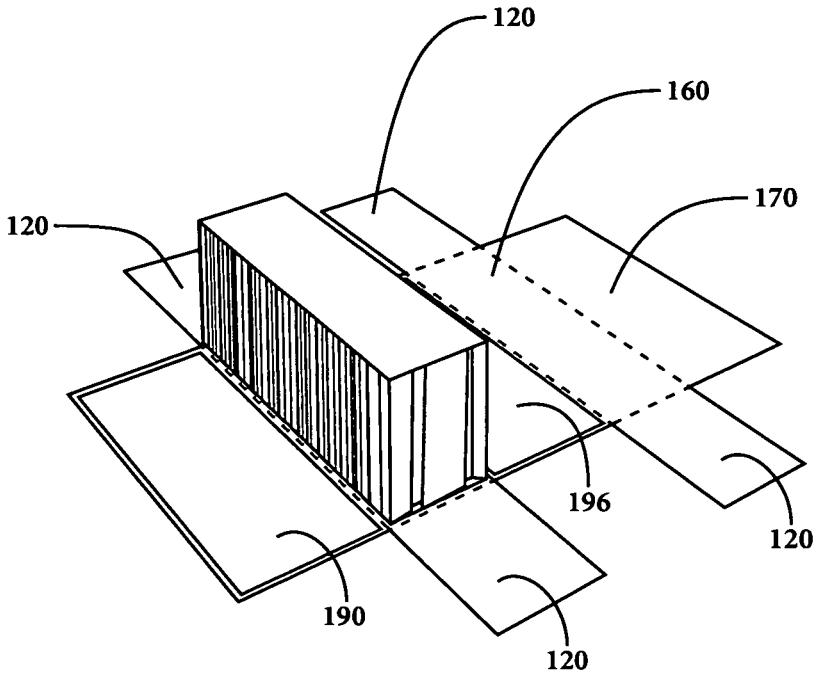
FIG. 11 is a perspective view of a die-cut corrugated paper sheet with honeycomb block and strip of paperboard applied to each side of the block.

FIG. 11 shows the placement of two strips of paperboard 190, 196, onto adhesive coated segments 130 and 150 of corrugated sheet 110. Both the paperboard strips and the honeycomb block have been pre-cut to fit exactly onto their segments.

Figure 12:
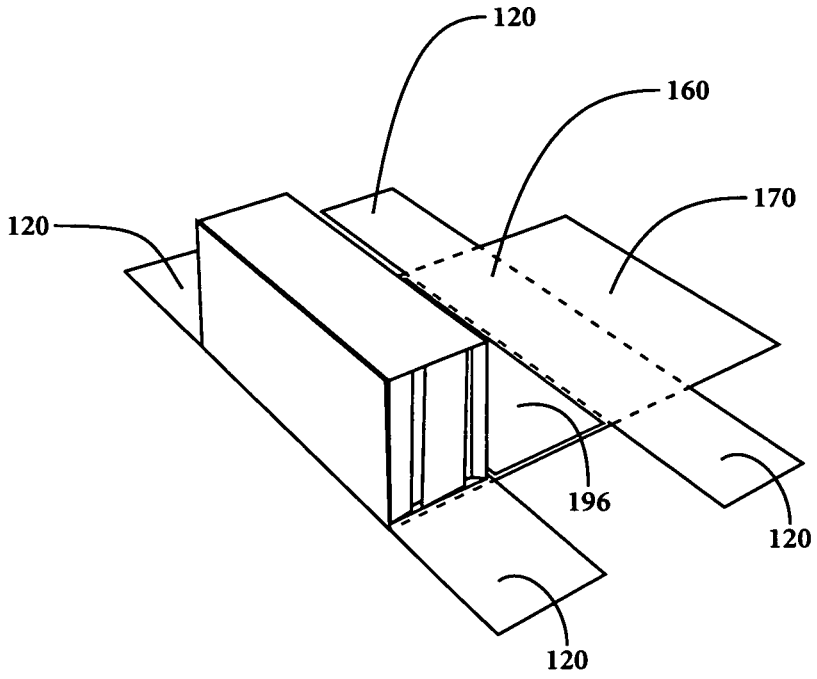
FIG. 12 is a perspective view of a step in the method of runner assembly.
Figure 13:
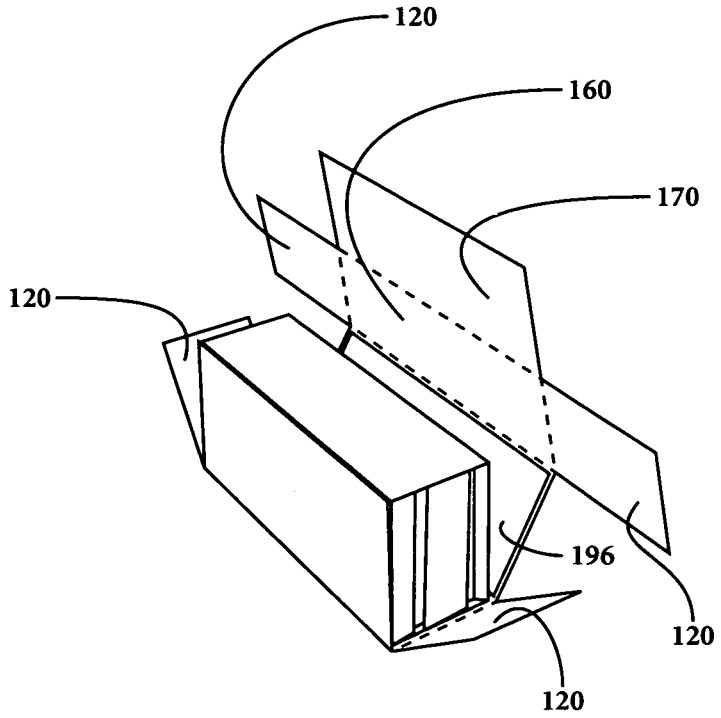
FIG. 13 is a perspective view of a step in the method of runner assembly.
Figure 14:
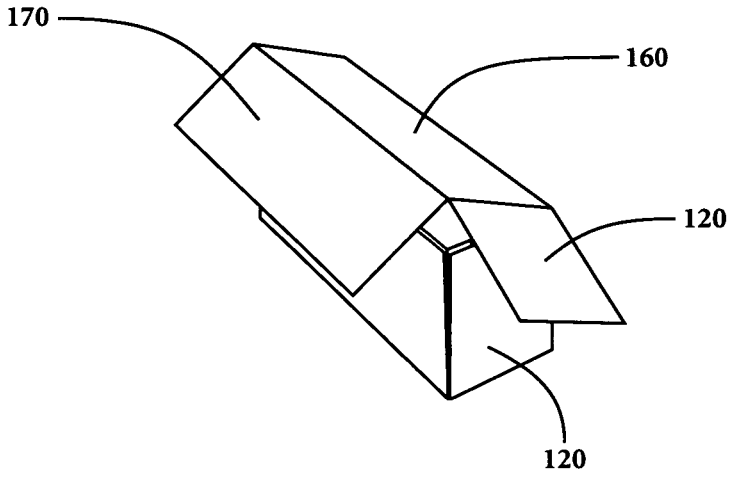
FIG. 14 is a perspective view of a step in the method of runner assembly.

The short block runner is now prepared for final assembly. As seen in FIG. 12 and FIG. 13 segments 130 and 150 are folded up and press the paperboard strips 190 and 196, against honeycomb block 180. Segment 160, with adhesive, is then pressed against the top of honeycomb block 180 (FIG. 14) allowing segment 170 to wrap over the top and cover the outside of segment 130, sealed by the adhesive. Segment 170 is further kept in place by application of several pieces of tape such as, for example, Kraft tape. The end cover flaps 120 on each end are also then pressed down to provide double coverage of the ends of the runner, which adds further strength. The completed runner is then spray coated with a refined petroleum and vegetable wax blend (not shown) to seal the corrugated board from moisture.

Figure 17:
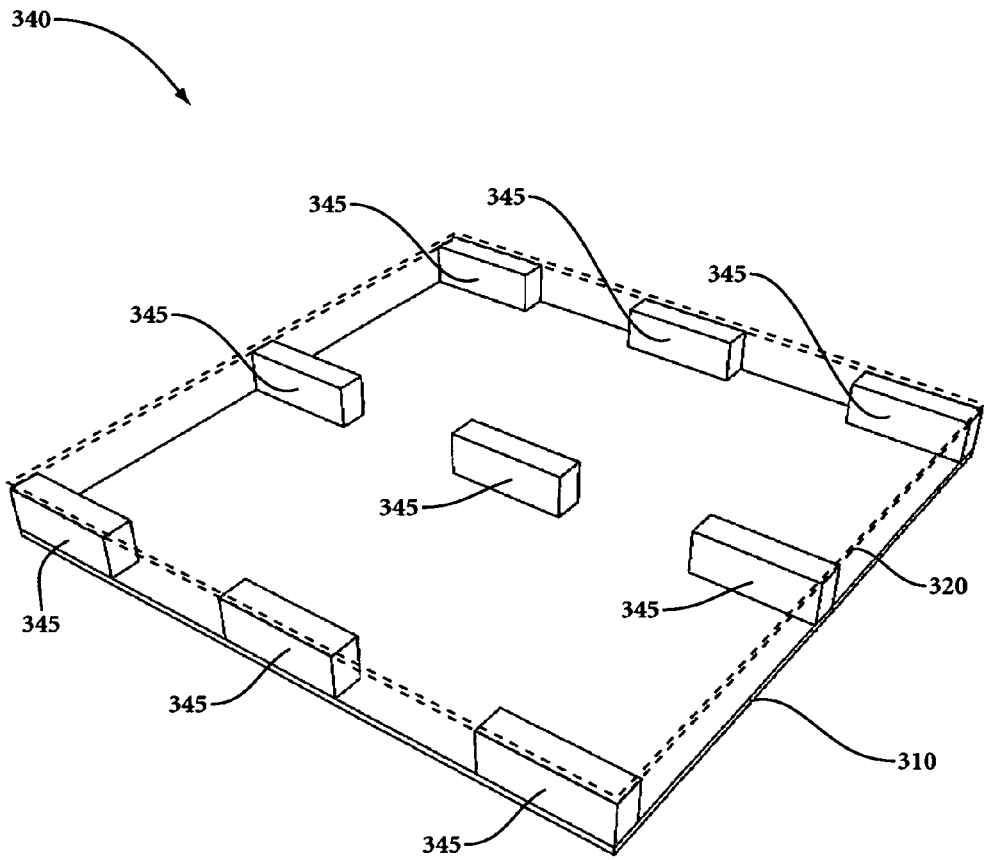
FIG. 17 is a perspective view of a pallet embodiment of the invention.

Assembly of one embodiment of a final 4-way entry pallet is then completed by first coating the top and bottom of the short block runners with adhesive and then spacing at least three runners across and between a top and bottom corrugated sheet as shown by the pallet 340 in FIG. 17. Rather than long continuous runners FIG. 17 shows nine short block runners 345 placed between an upper and lower paperboard sheet. Because of this configuration forklift access from any side of the pallet is possible.

Figure 18:
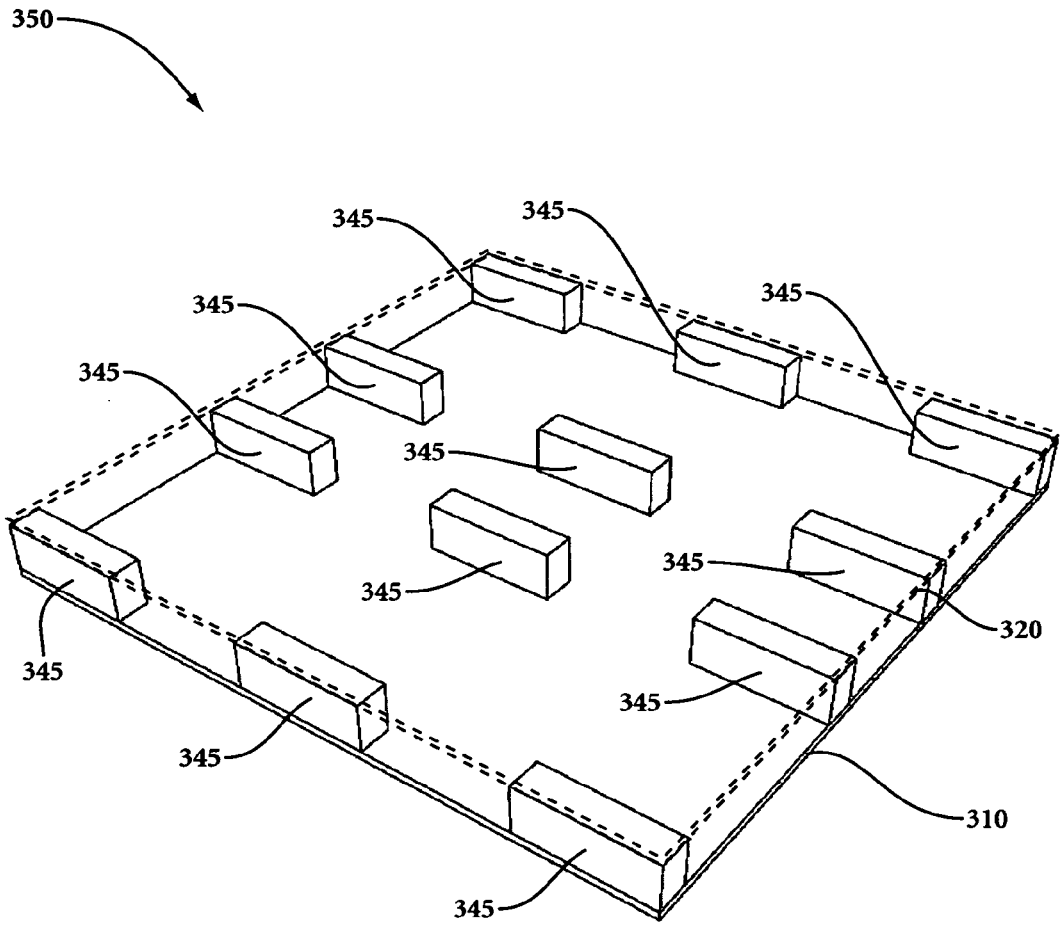
FIG. 18 is a perspective view of a pallet embodiment of the invention.

Similarly, for added strength an alternate pallet can be prepared as shown by numeral 350 in FIG. 18. In this pallet embodiment 12 short block runners can be attached by adhesive between a top and bottom corrugated sheet. As previously, the top corrugated sheet is rendered as transparent for clarity. Again, in this configuration forklift access from any side of the pallet is possible.

In all of the pallet embodiments of FIGS. 15, 16, 17, and 18 the final assembled pallet can also be spray coated with a blend of refined petroleum and vegetable wax blend to seal the corrugated boards from moisture.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims are intended to embrace all such changes, modifications and variations that may occur to one of skill in the art upon a reading of the disclosure.

The invention claimed is:

1. A corrugated pallet for supporting a load during transport and storage comprising:

a. a series of spaced parallel two way access runners, each of the runners comprising the following components:

I. a die cut corrugated sheet comprising five joined parallel segments of length L, with the second and fourth segments having extended end flaps;

II. a rectangular corrugated block of length L, attached adhesively to the second and fourth segments of the die cut corrugated sheet;

III. two paperboard strips of length L, attached adhesively to the first and third segment of the die cut corrugated sheet;

IV. wherein the extended end flaps are attached adhesively over the ends of the assembled runner;

b. wherein each two way access runner is created by:

I. applying an adhesive on the interior side of the die cut corrugated sheet, coating all five joined parallel segments and their end flaps;

II. adhesively attaching the corrugated block onto the second parallel segment;

III. adhesively attaching the paperboard strips on the first and third parallel segments;

IV. folding, pressing, and adhesively attaching the first and third parallel segments with attached strips of paperboard against said rectangular corrugated block on the second segment of the die cut corrugated sheet;

V. adhesively attaching the fourth parallel segment against the top of said rectangular corrugated block, allowing the adhesively coated fifth parallel segment to wrap over the top and cover the outside of the first parallel segment;

VI. adhesively attaching the extended end flaps on each end of the assembled runner;

c. a corrugated top sheet joined to the tops of the runners using adhesive applied to the horizontal upper surface of the runner;

d. a corrugated bottom sheet joined to the bottoms of the runners using adhesive to the horizontal bottom surface of the runner.

2. The corrugated pallet of claim 1 further comprising a sprayed coating of a petroleum and vegetable wax blend over the completed pallet.

3. The corrugated pallet of claim 2 wherein the corrugated rectangular blocks of length L are Honeycomb blocks.

4. A corrugated pallet for supporting a load during transport and storage comprising:

a. a series of spaced parallel four way access runners, each comprising multiple spaced apart short block runners, having openings extending the entire width of the runner in a direction perpendicular to a longitudinal axis of the runner, each of the spaced apart short block runners comprising the following components:

I. a die cut corrugated sheet comprising five joined parallel segments of length L, with the second and fourth segments having extended end flaps;

II. a rectangular corrugated blocks of length L;

III. two paperboard strips of length L;

b. wherein each spaced apart short block runner is created by:

I. applying an adhesive on the interior side of the die cut corrugated sheet, coating all five joined parallel segments and their end flaps;

II. adhesively attaching the corrugated block onto the second parallel segment;

III. adhesively attaching the paperboard strips on the first and third parallel segments;

IV. folding, pressing, and adhesively attaching the first and third parallel segments with attached strips of paperboard against said rectangular corrugated block on the second segment of the die cut corrugated sheet;

V. adhesively attaching the fourth parallel segment against the top of said rectangular corrugated block, allowing the adhesively coated fifth parallel segment to wrap over the top and cover the outside of the first parallel segment;

VI. adhesively attaching the extended end flaps on each end of the assembled short block runner.

c. a corrugated top sheet joined to the tops of the 4-way access runners using adhesive applied to the horizontal upper surface of the 4-way access runner;

d. a corrugated bottom sheet joined to the bottoms of the 4-way access runners using adhesive to the horizontal bottom surface of the 4-way access runners.

5. The corrugated pallet of claim 4 further comprising a sprayed coating of a petroleum and vegetable wax blend over the completed pallet.

6. The corrugated pallet of claim 5 wherein the corrugated rectangular blocks are Honeycomb blocks.

7. A method for preparing a corrugated runner for a corrugated pallet comprising the steps of:

a. preparing a die cut corrugated sheet comprising five joined parallel segments, with the second and fourth segments having extended end flaps;

b. spray coating an adhesive on the interior side of the die cut corrugated sheet, coating all five joined parallel segments and their end flaps;

c. glueing a rectangular corrugated block on the second segment of the die cut corrugated sheet;

d. placing strips of paperboard onto the first and third parallel and adhesively coated segments;

e. folding and pressing said first and third parallel segments with attached strips of paperboard against said rectangular corrugated block on the second segment of the die cut corrugated sheet;

f. pressing the adhesively coated fourth parallel segment against the top of said rectangular corrugated block, allowing the adhesively coated fifth parallel segment to wrap over the top and cover the outside of the first parallel segment;

g. pressing two adhesively coated end flaps down on each end of the assembled runner to provide double coverage of the ends.

8. The method of preparing a corrugated runner for a corrugated pallet of claim 7 further comprising spray coating the completed runner to seal the corrugated board from moisture.

9. The method of preparing a corrugated runner for a corrugated pallet of claim 8 wherein the spray coating is made with a petroleum and vegetable wax blend.

* * * * *